United States Patent [19]

Baldwin

[11] Patent Number: 4,854,621

[45] Date of Patent: Aug. 8, 1989

[54] REINFORCED DOOR SECURITY ASSEMBLY

[76] Inventor: Robert L. Baldwin, 14149 Jim Bridger, El Paso, Tex. 79935

[21] Appl. No.: 145,060

[22] Filed: Jan. 19, 1988

[51] Int. Cl.[4] ..... E05C 21/00

[52] U.S. Cl. ..... 292/340; 49/504

[58] Field of Search ..... 292/341.18, 341.19, 292/346, 340; 70/417; 49/504; 52/213

[56] References Cited

U.S. PATENT DOCUMENTS

| | | | |
|---|---|---|---|
| 1,010,365 | 11/1911 | Hensle . | |
| 1,187,631 | 6/1916 | Landers | 292/346 |
| 1,610,369 | 12/1926 | Goddard | 47/504 |
| 1,863,487 | 6/1932 | Kirkpatrick | 292/346 |
| 2,695,807 | 11/1954 | Bissot | 292/341.18 |
| 2,695,808 | 11/1954 | Manchester | 292/341.18 |
| 3,405,962 | 10/1968 | Sushan | 292/346 |
| 3,888,530 | 6/1975 | Fabrici | 292/340 |
| 3,918,207 | 11/1975 | Aliotta | 52/514 |
| 4,057,275 | 11/1977 | La Beaud | 292/340 |
| 4,171,836 | 10/1979 | St. Aubin | 292/341.18 |
| 4,174,862 | 11/1979 | Shane | 292/346 |
| 4,178,027 | 12/1979 | Charron | 292/346 |
| 4,195,870 | 4/1980 | Percoco | 292/340 |
| 4,295,299 | 10/1981 | Nelson | 49/504 |
| 4,369,994 | 1/1983 | Vorves | 292/340 |
| 4,383,709 | 5/1983 | Ronan | 292/346 |
| 4,416,087 | 11/1983 | Ghatak | 292/346 |
| 4,474,394 | 10/1984 | Crepinsek | 292/340 |
| 4,547,009 | 10/1985 | Allen | 292/346 |
| 4,684,160 | 8/1987 | Nelson | 292/340 |
| 4,717,185 | 1/1988 | Hartley | 292/346 |
| 4,720,129 | 1/1988 | Bouchard | 292/346 |

FOREIGN PATENT DOCUMENTS

| | | | |
|---|---|---|---|
| 651541 | 9/1958 | Canada | 49/504 |
| 821429 | 8/1969 | Canada | 292/56 |
| 17808 | 7/1910 | United Kingdom . | |

*Primary Examiner*—Richard E. Moore
*Assistant Examiner*—Erik K. Nicholson
*Attorney, Agent, or Firm*—Brown, Martin, Haller & McClain

[57] ABSTRACT

A door security assembly comprises a generally U-shaped striker plate member for fitting transversely around one side edge of a door frame and having a first arm for facing into the door opening having an opening for receiving a door latch, and a second, parallel arm for fitting between the door frame and the surrounding doorway in the wall. The striker plate member is secured to the doorway in the wall by means of a securing device which extends transversely through the first arm, door frame and second arm into a stud member in the surrounding doorway. Additional reinforcement may be provided by a tie plate which is secured to an outer wall surface and extends between the door frame and second arm, the securing device extending through both the striker plate member and tie plate.

7 Claims, 1 Drawing Sheet

FIG. 1
PRIOR ART
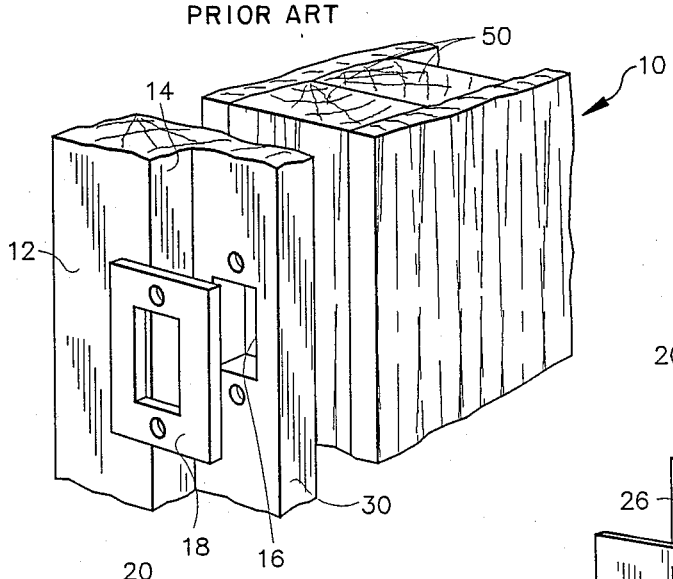
FIG. 5
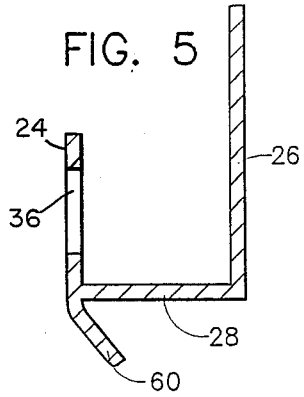
FIG. 2
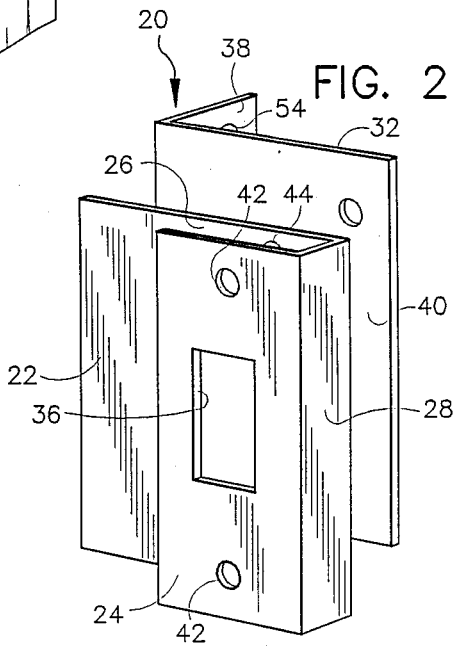
FIG. 4
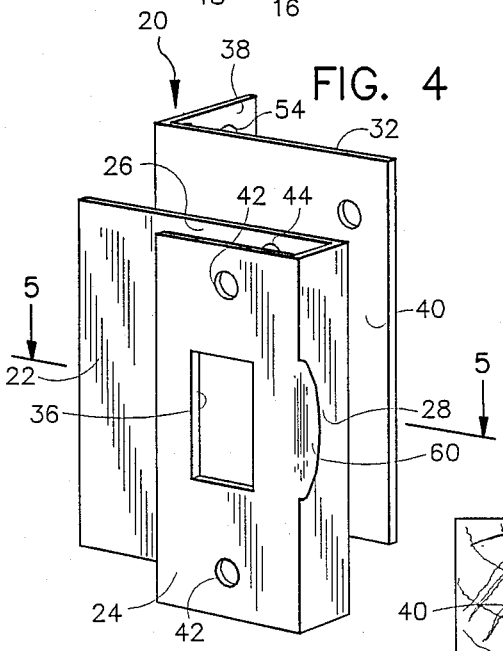
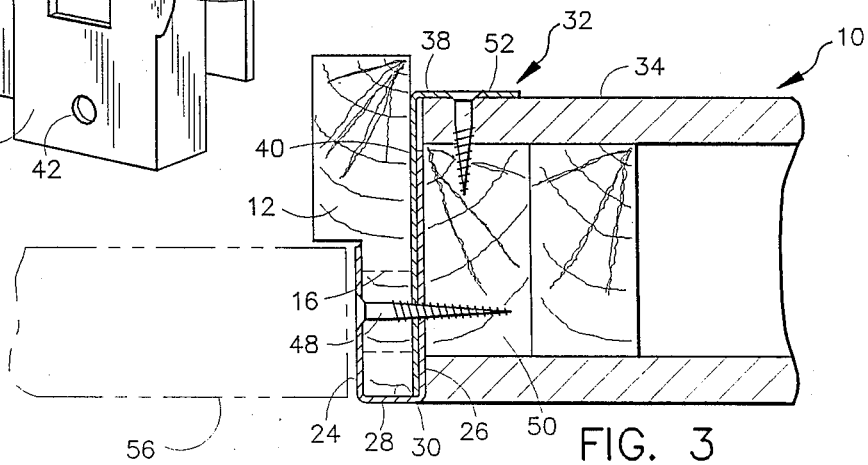
FIG. 3

REINFORCED DOOR SECURITY ASSEMBLY

BACKGROUND OF THE INVENTION

The present invention relates to a door security assembly for improving the strength of a door lock for locking a door in a doorway.

Standard door locks generally comprise latches or bolts on the side edge of a door which engage in suitably aligned apertures in co-operating striker plates on the wooden door frame or jamb which is mounted in the doorway. One problem with such locks is that they can be forced open by kicking in the door, ripping away the wood framing from the doorway and thus also releasing the lock.

Various devices have been proposed in the past for improving the security of door locks. Some of these are relatively complex and involve substantial reworking of the door frame area. Others are aimed at preventing jimmying of locks by inserting a suitable tool between the door and striker plate to release the lock.

In U.S. Pat. No. 4,383,709 of Ronan, for example, a safety device is described which comprises a metal strip for overlapping the door when the door is closed, to resist insertion of anything between the door and door jamb.

U.S. Pat. No. 3,888,530 of Fabrici shows a door guard which comprises a guard plate which overlaps the door frame and the wall surrounding the door opening, with the sides of the guard plate being secured to the studs surrounding the door opening. This will act to reinforce the door lock against forcible entry.

SUMMARY OF THE INVENTION

It is an object of the present invention to provide a door security assembly for reinforcing a door jamb or frame and reducing the risk of forcible entry by kicking out a door jamb or frame.

According to the present invention a security assembly for reinforcing a door lock for securing a door to a door frame in a doorway is provided, which comprises a generally U-shaped member having a pair of arms connected by a web portion for fitting transversely across one side edge of a door frame with one arm lying against the door engaging face of the frame and the other arm lying between the opposite face of the frame and the doorway in the wall. A securing device is provided for securing the U-shaped member directly to the doorway or wall surrounding the door opening. The securing device extends transversely through the two arms and into a building stud in the wall surrounding the door opening.

The U-shaped member may have one or more openings for receiving a door locking member such as a latch or bolt and can replace the standard striker plate which is secured only to the relatively weak wooden door frame. Since the U-shaped striker plate member is secured to the doorway as well as the frame, it will be much stronger and more resistant to being kicked or forced out. In most doorways, a double 2 x 4 building stud in the wall surrounds the opening. This is structurally very strong, and since the U-shaped member will be anchored to this structure, the assembly will be very resistant to being forced away from the wall.

Preferably, the assembly also includes a tie plate for additionally securing the U-shaped member to an outer face of the wall, for extra reinforcement. In the preferred embodiment of the invention, the tie plate comprises an L-shaped member with one portion for lying against an outer face of the wall surrounding a door opening, and a second portion for extending between the door frame and doorway. A securing device is provided for securing the first portion of the tie plate to the wall, and the second portion is designed to extend between the second arm of the U-shaped member and the door frame, so that the U-shaped member securing device extends through both arms of the U-shaped member as well as the second portion of the L-shaped tie plate before entering the wall or stud surrounding the door opening. This will further resist forcible entry and provide a very strong structure when assembled with securing devices such as screws passing through both elements of the assembly into the underlying wood structure of the wall surrounding the doorway.

The assembly of this invention can be mounted on an existing door frame with very little rework of the door frame area being required, and produces a very strong structure for resisting forcible entry by kicking in of a door jamb or frame. In existing doors, the assembly can be mounted by simply removing the existing flat striker plate, removing the wooden door trim moldings and mounting the U-shaped plate around the edge of the frame. The door trim moldings are re-attached and one or more connecting screws driven through the U-shaped and L-shaped plates and frame into the supporting building stud surrounding the doorway opening.

BRIEF DESCRIPTION OF THE DRAWINGS

The present invention will be better understood from the following detailed description of a preferred embodiment of the invention, taken in conjunction with the accompanying drawings, in which like reference numerals refer to like parts and in which:

FIG. 1 is a partial perspective view of the side edge of a doorway in the lock area, showing a prior art striker plate;

FIG. 2 is a perspective view of a door security assembly according to a preferred embodiment of the present invention;

FIG. 3 is a horizontal cross sectional view showing the door security assembly of FIG. 2 mounted in a doorway;

FIG. 4 is a view similar to FIG. 2 showing a modification to the striker plate number for use with a spring latch type door knob striker; and FIG. 5 is a section on line 5—5 of FIG. 4.

DESCRIPTION OF THE PREFERRED EMBODIMENT

Most standard doorways consist of an opening of suitable size in a wall 10, and a wooden door frame 12 which is mounted in the wall opening to surround the doorway. The frame has an indent or step 14 which provides a stop against which the door closes. Conventional door locks generally comprise latches or bolts on the free side edge of the door which engage in suitably aligned apertures 16 in the wooden frame and in co-operating, flat striker plates 18 mounted on the wooden frame as indicated in FIG. 1. The striker plate 18 will be provided with a curved receiving lip (not shown) when it is used with a spring latch type door knob striker. This ensures that no damage to the door trim can result from closing the door. Such conventional door locks are not particularly secure against forcible entry since they can be kicked in relatively easily, ripping the structurally weak wood framing away from the doorway and releasing the lock.

FIGS. 2 and 3 of the drawings show a door security assembly 20 according to a preferred embodiment of the present invention for reinforcing a door lock against forcible entry. The assembly 20 basically comprises a generally U-shaped striker plate member 22 having a pair of different length arms 24,26 connected by a web portion 28 and designed to wrap around the inner side edge 30 of the door frame 12, as shown in FIG. 3. A tie plate 32 which is generally L shaped is designed to hook over the outer wall surface 34 adjacent the doorway, as indicated in FIG. 3. The striker plate member 22 is designed to replace the standard striker plate 18 shown in FIG. 1 and will preferably have at least one opening 36 in its shorter arm 24 for alignment with a corresponding opening 16 in the underlying door frame for receiving the door bolt or latch. Clearly the arrangement of the opening or openings will depend on the particular type of door lock with which the assembly is to be used.

The striker plate member is designed to fit around the edge of the door frame as shown in FIG. 3 so that the shorter arm 24 lies against the outer face of the door frame in place of a standard, flat striker plate and the longer arm 26 fits between the door frame and outer face of the doorway. The tie plate is designed to hook over the outer wall surface with its shorter leg 38 lying against the wall surface and its longer leg 40 extending into the gap between the door frame and the doorway, so that it engages between the arm 26 of the U-shaped member and the inner face of the door frame as shown in FIG. 3.

As best seen in FIG. 3, the two arms 24 and 26 of the U-shaped member have openings 42, 44, respectively, which are aligned as shown in FIG. 2. An aligned opening 46 in the longer leg 40 of the tie plate will be drilled by the installer. The aligned openings then receive screws 48 which extend through arm 24, door frame 12, leg 40 and arm 26 into the underlying wall structure surrounding the doorway. Generally, a double 2×4 stud 50 in the wall surrounds the door opening, as shown in FIGS. 1 and 3, and this is structurally very strong. Thus the plates 22 and 32 are tied together and anchored to the strong underlying structure surrounding the wall opening. For additional reinforcement, the shorter leg 38 of the tie plate is anchored via one or more screws 52 which pass through one or more oepnings 54 in leg 38 into the underlying wall surface and through the wall facing into the underlying stud 50.

The two parts 22, 32 of the reinforcing assembly are suitably of metal, and the dimensions of the parts 22, 32 are dependent on the dimensions of the doorway and door frame on which they are to be installed. Thus U-shaped member 22 is dimensioned to fit around the narrower edge of the door frame on which it is to be installed, leaving a gap sufficient to receive leg 40 of the tie plate as shown in FIG. 3. The shorter arm 24 will be of a length equivalent to that of the existing striker plate which it replaces, while the web portion 28 will have a length slightly greater than the door frame thickness at its thinner, inner edge. The length of longer leg 40 of the tie plate will be slightly less than the width of the doorway, while arm 26 may be equal to or slightly shorter than leg 40.

The reinforcing assembly described above is relatively easy to install. In new buildings, the striker member and tie plate can be positioned as indicated in FIG. 3 prior to attachment of the wooden door trim or moldings in the doorway. In existing doors, the existing striker plate is first removed. The door trim or molding is then removed so that the striker plate member can be placed around the inner edge of the door frame with one arm between the door frame and doorway, while the tie plate is hooked over the outside of the wall next to the doorway so that one leg extends between the door frame and the arm of the striker plate member. The door trim or molding is then secured to the doorway and the screws are screwed through the striker plate member and tie plate as shown in FIG. 3 to anchor both members together and to the underlying supporting building stud. The striker plate member will then face the free edge of a door 56 when the door is closed as shown in FIG. 3.

The assembly shown in FIGS. 2 and 3 is designed primarily for replacement of dead bolt striker plates. FIGS. 4 and 5 illustrate a modification to the striker plate member for use in conjunction with spring latch-type door knob strikers. In this modification, the member 22 is provided with a curved lip 60 projecting outwardly from the edge of web portion 28. This lip acts as a guide for the door spring latch as the door is closed, ensuring that no damage to the door trim occurs as the door is closed.

The door security assembly for a door lock described above is structurally very strong and resistant to forcible entry by kicking in the door. When a door having a striker plate as shown in FIG. 1 is kicked in, the wood frame will be ripped away from the doorway relatively easily to release the lock. However, if a door is mounted with the security assembly as shown in FIGS. 2 and 3, the door frame adjacent the lock cannot be forced away from the wall easily since both the assembly 20 and the frame are anchored to the underlying building stud. Thus, the only effective way to force entry would be to kick in the door itself. Although this may be feasible if the door is of hollow core construction, it will be more or less impossible in the case of strong, solid core doors. The door security assembly of this invention therefore provides a relatively inexpensive way to reinforce exterior and other doors against forcible entry. The tie plate adds further reinforcement in tying the striker plate assembly to the outer wall surface in addition to the doorway opening, but a significantly reinforced structure can also be produced using the U-shaped striker plate member alone. Although a preferred embodiment of the present invention has been described above by way of example only, it will be understood by those skilled in the field that modifications may be made to the disclosed embodiment without departing from the scope of the invention, which is defined by the appended claims.

I claim:

1. A door security assembly for reinforcing a door frame in the vicinity of a door lock opening in the frame, comprising:

a generally U-shaped striker plate having a pair of side arms connected by a web portion adapted to fit transversely around a side edge of a door jamb, a first one of the arms having an opening for alignment with a door lock opening in an outer, exposed face of the door jamb;

an L-shaped tie plate comprising means for securing the striker plate to an outer face of a wall adjacent a doorway opening, the longer leg of the tie plate being of length at least equal to the second arm of the striker plate and comprising means for extending between an inner, concealed face of a door jamb and the second arm of the striker plate, and the shorter leg of the tie plate comprising means for resting against an outer face of a wall adjacent the door jamb;

first securing means for extending transversely through the side arms of the striker plate and the longer leg of the tie plate to secure the tie plate to the striker plate and to secure both plates to the underlying door frame; and second securing means for extending through the shorter leg of the tie plate and underlying wall surface into an underlying structural member.

2. The assembly as claimed in claim 1, wherein said plate member has a curved receiving lip projecting outwardly from said first side arm for guiding the spring latch of a door lock as the door is closed.

3. A reinforced door assembly, comprising:

a wall having a door opening, and reinforcing structural members between opposed outer faces of the wall adjacent the door opening;

a door frame mounted in the door opening, the frame including an upright jamb piece extending on one side of the door opening, the jamb piece having an outer exposed face with an opening for receiving a door lock and an inner concealed face facing one of said structural members;

a door to be hinged to the opposite side of the door frame to said jamb piece for movement between an open and closed position;

the door for use with a locking mechanism on its opposite side edge for engagement in said lock opening in its closed position to releasably lock the door; and a security assembly for reinforcing the door frame adjacent the locking opening, the security assembly comprising:

a U-shaped striker plate member comprising a pair of parallel side arms connected by a web portion, the member engaging transversely around said jamb piece in the vicinity of said lock opening with one of said side arms lying against the outer exposed face of said jamb piece and the other arm extending in a first direction into the gap between said inner, concealed face and said structural member;

an L-shaped tie plate member having a first leg lying against an outer face of the wall adjacent the door opening and a second leg extending in the opposite direction to said striker plate arm into the gap between the jamb piece and structural member, the second leg being located between the inner face of the jamb piece and the innermost arm of the striker plate member;

the arms of the striker plate member and second leg of the tie plate member having aligned openings;

first securing means extending through the aligned openings in the plate members and through the jamb piece into the underlying structural member to secure the plate members together and to the structural member; and second securing means extending through the first leg of the tie plate member and outer wall face into the structural member.

4. The assembly as claimed in claim 3, wherein the outermost arm of the striker plate member has an opening aligned with said door lock opening.

5. The assembly as claimed in claim 3, wherein the second leg of the tie plate member is substantially longer than the first leg and is of length at least equal to that of the innermost arm of the striker plate member.

6. The assembly as claimed in claim 3, wherein said first and second securing means comprise screws or nails of sufficient length for securely connecting said plates to one or more underlying structural members.

7. A method of reinforcing a door frame in the vicinity of a door lock, comprising of the steps of:

inserting a generally U-shaped striker plate member having a pair of side arms connected by a web portion in a first direction around one side edge of a door jamb with a first arm engaging an outer face of the door jamb and the second arm inserted between an inner face of the jamb and an underlying structural member in the door frame;

inserting the longest leg of a generally L-shaped tie plate member in the opposite direction to the striker plate member into a gap between the inner face of the door jamb and the second arm of the striker plate member until the shorter leg of the tie plate member lies against the outer face of the wall adjacent the door opening;

securing the striker and tie plate members together and to the underlying jamb and structural member by extending fastener members transversely through the first arm of the striker plate member, the door jamb, the longer leg of the tie plate member, the second arm of the striker plate member, and into the underlying structural member; and securing the shorter leg of the striker plate member to the outer face of the wall by extending a fastener member transversely through the shorter leg, the outer face of the wall and into the underlying structural member.

* * * * *